US005746421A

United States Patent [19]

Bowerman

[11] Patent Number: 5,746,421

[45] Date of Patent: May 5, 1998

[54] BOARD HOLDING DEVICE

[76] Inventor: Dean E. Bowerman, 9725 Hawkins Ct., Elk Grove, Calif. 95624

[21] Appl. No.: 705,290

[22] Filed: Aug. 29, 1996

[51] Int. Cl.[6] ..... B25B 5/14

[52] U.S. Cl. ..... 269/41

[58] Field of Search ..... 269/41, 45, 152, 269/153, 154, 155, 37

[56] References Cited

U.S. PATENT DOCUMENTS

| | | | |
|---|---|---|---|
| 842,007 | 1/1907 | Parker | 269/45 |
| 3,883,128 | 5/1975 | Breese | 269/45 |
| 4,165,869 | 8/1979 | Williams | 269/41 |
| 4,340,100 | 7/1982 | Anderson | 269/41 |
| 4,836,517 | 6/1989 | Vossler . | |
| 5,192,059 | 3/1993 | Silver | 269/41 |
| 5,228,667 | 7/1993 | Bridegum . | |
| 5,489,088 | 2/1996 | Warter | 269/41 |

*Primary Examiner*—Robert C. Watson

*Attorney, Agent, or Firm*—Patent & Trademark Services; Thomas Zack; Joseph H. McGlynn

[57] ABSTRACT

Metal board holder used in the construction industry having base and body plate members. Each member has a board receiving U-shaped bracket with nail receiving holes. A base plate adjustment slot can receive one or more threaded body plate member extensions which ride in it to permit plate member adjustments with respect to each other. The body plate member is pivotally mounted to its bracket and has several hinged plate sections the lowermost of which mounts the threaded extension. Locking nuts engage the threaded extension when it is inserted into the base plate's slot to fix the plate with respect to each other. Many types of board holding orientations are disclosed.

4 Claims, 2 Drawing Sheets

BOARD HOLDING DEVICE

BACKGROUND OF THE INVENTION

When large wood beams are used in the building structures, it may be difficult or impossible for a single person to both support and align one of their ends while fixing the other end. Various types of jigs or clamping and holding devices are known which both hold and align the beams to be fixed to each other freeing the builder to work on its other end. With the present invention different sized boards oriented at different angular disposition can be supported and aligned relative to each other while work is performed elsewhere.

DESCRIPTION OF THE PRIOR ART

Various types of tools which hold and support wood rafters, joists and other wooden supports are known. For example, U.S. Pat. No. 4,340,100 to Anderson provides for a rafter Jig with an angular rafter bracket and a rafter support swingably connected to the bracket. Others, such as U.S. Pat. No. 4,836,517 to Vossler, are directed to specific tasks like temporarily suspending and supporting a fasica board during installtion and have a U-shaped frame and a rectangular frame with each frame having board attachment means. With another such facia clamping and holding device, U.S. Pat. No. 5,228,667 to Bridgegum, the desired facia's angular and height disposition is adjusted with a pivotally connected slidable support bracket. U.S. Pat. No. 5,192,059 to Silver uses a channel section mounted on a roof rafter pivotally connected to an adjustable facia board holder. While each of these prior art inventions have benefits for the purposes disclosed, none have the unique and straightforward multiuse design purpose of the present invention as disclosed herein.

SUMMARY OF THE INVENTION

An adjustable board holder having a base member and an adjustably mounted body member. Both members have board receiving brackets with the body bracket member's pivotly connected to it. The body member has hinged sections with at least one threaded extension which fits through a slot hole in the lower body member. This extension along with a threaded nut holds the members together when fitted through a slot in the base member. Nail holes both board receiving brackets permit them to be temporarily fixed to the boards.

DESCRIPTION OF THE PREFERRED EMBODIMENT

Figure 1:
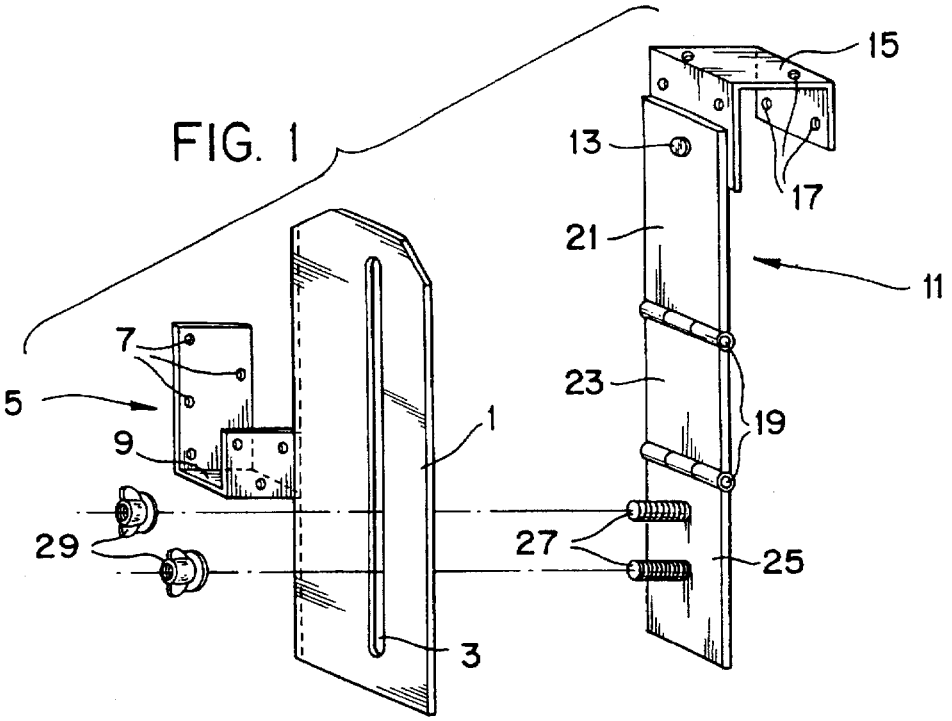
FIG. 1 shows the preferred embodiment of the holder's unassembled body and base members.

FIG. 1 shows the basic components for the holder's preferred embodiment. The light weight metal reversible base member 1 has an elongated hole slot 3 extending most, but not all of, its entire height. Fixed at a right angle to the base member is a board receiving U-shaped metal bracket 5 having one or more holes 7 through which nails, up to about 16*d* diameter, can be driven into boards. The bracket's seat 9 is spaced from its two sides such that it can accommodate the nominal two inches of a 2×4, 2×6, etc. board.

The interconnecting metal body member 11 is pivotally mounted by swivel pin 13 to the U-shaped board receiving bracket 15. Like the base's bracket, the body bracket has one or more nail receiving holes 17 which can accommodate up to about 16*d* diameter nails. Down from its swivel connection, the metal body member has two spaced hinged connections 19 which permit its interconnected plate sections 21,23, and 25 to pivot relative to each other. Along with its upper swivel mount 13, these hinged connection allow the body member to adjust to a variety of different set ups. On the body's lower plate section 25 are two extending threaded extensions 27 whose diameters are such that they fit through the slot 3 in the base member. When placed in the slot, wind nuts 29 can be threaded over the extensions ends to join the base and body members to each other. By moving body member relative to the slotted base member, when the threaded extensions are in place, the members can be adjusted relative to each other and then locked in place with the nuts.

Figure 2:
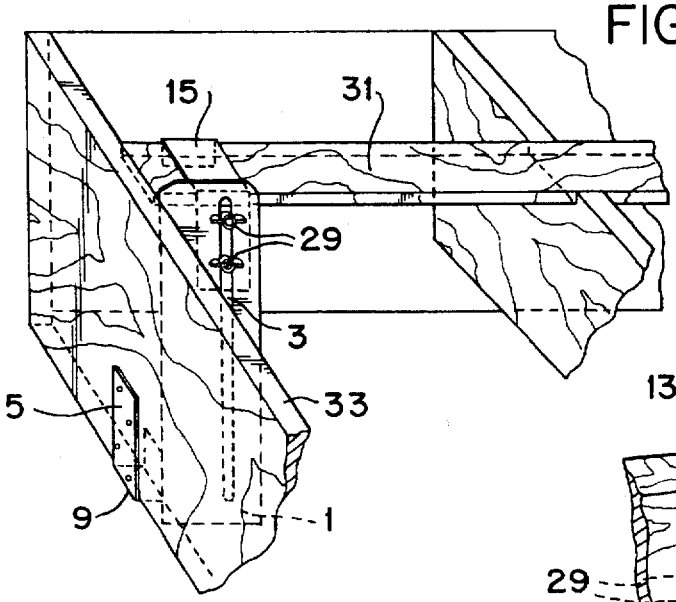
FIG. 2 depicts the holder attached to an out-rigger and a barge board.

Many different types of board holding and supporting relationships are possible with the described holder with its interconnected base/body members. FIG. 2 shows one relationship where an out-rigger board 31 is engaged by the body's U-shaped bracket 15 while the base member's bracket 5 is temporarily nailed to the barge 33. In this case, the base bracket is first nailed in place and then the body bracket is adjusted to engage the out-rigger. Since the base member can swing freely, the body member can slide up or down in the slot 3 as its threaded extensions 27 ride and use the slot as a guide. This allows the barge to be aligned with the center of the roof's ridge up and down the pitch of the roof. Finally, when the proper positioning is achieved, the two wing nuts 29 are tightened to keep the brackets in place.

Figure 3:
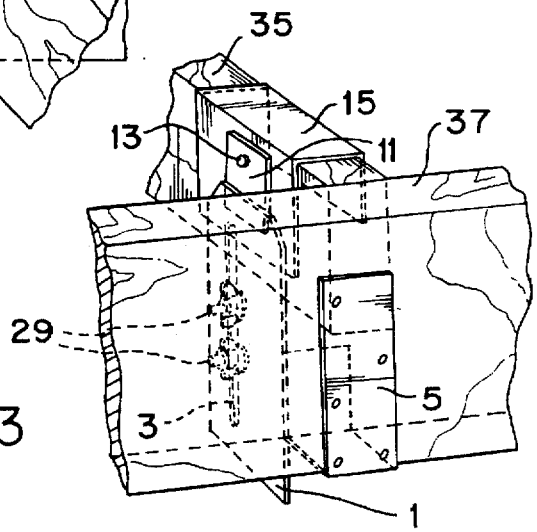
FIG. 3 illustrates another use of the holder with a rafter tail and facia board.

FIG. 3 illustrates another use of the holder with a rafter tail and facia board. In this application, the bracket 15 is attached to the rafter tail 35 with 16*d* nails. The swivel connection 13 insures a plumb positioning of the body member 11. After vertically adjusting the threaded extensions in base member's slot 3 with the bracket 5 craddling the facia board 37, the two wing nuts 29 are tighten to maintain the holder in place.

Figure 4:
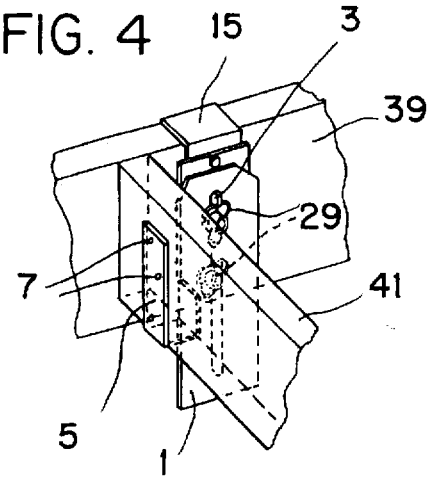
FIG. 4 shows the holder used as a rafter jig.

FIG. 4 shows the holder used as a rafter jig. When a ridge board 39 is used the bracket 15 is attached to it and the base member bracket 5 adjusted to engage the bottom of the rafter 41. Side holes 7 in the bracket 5 permit nails to be used more securely hold the bracket to the rafter.

Figure 5:
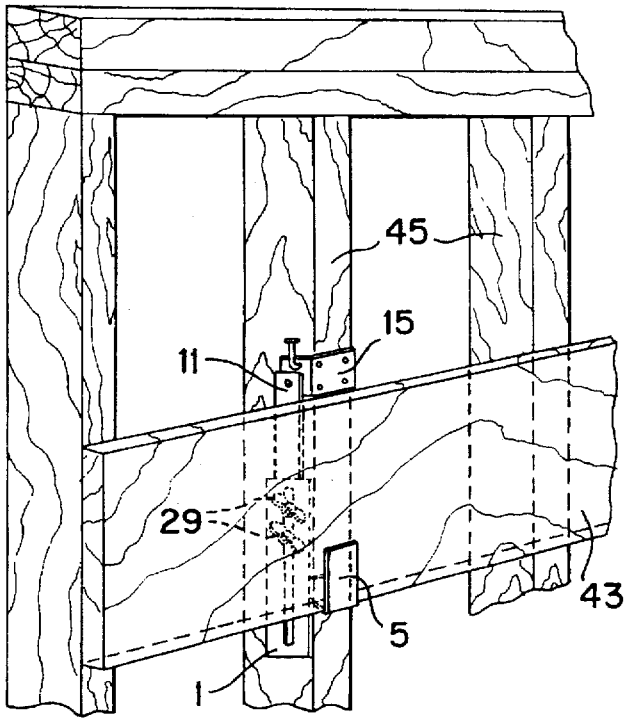
FIG. 5 employs the holder as a ledger jig.

FIG. 5 shows still another application where the holder is employed as a ledger jig. The ledger board 43 is vertically supported on the wall studs 45 by attaching the bracket 15 to a stud with nails. She base bracket 5 support's the bottom of the ledger board and is held to it by nails. Depending on the size of the ledger board, the vertical adjustment of the base member to the body member is made and the wing nuts 29 tighten.

Figure 6:
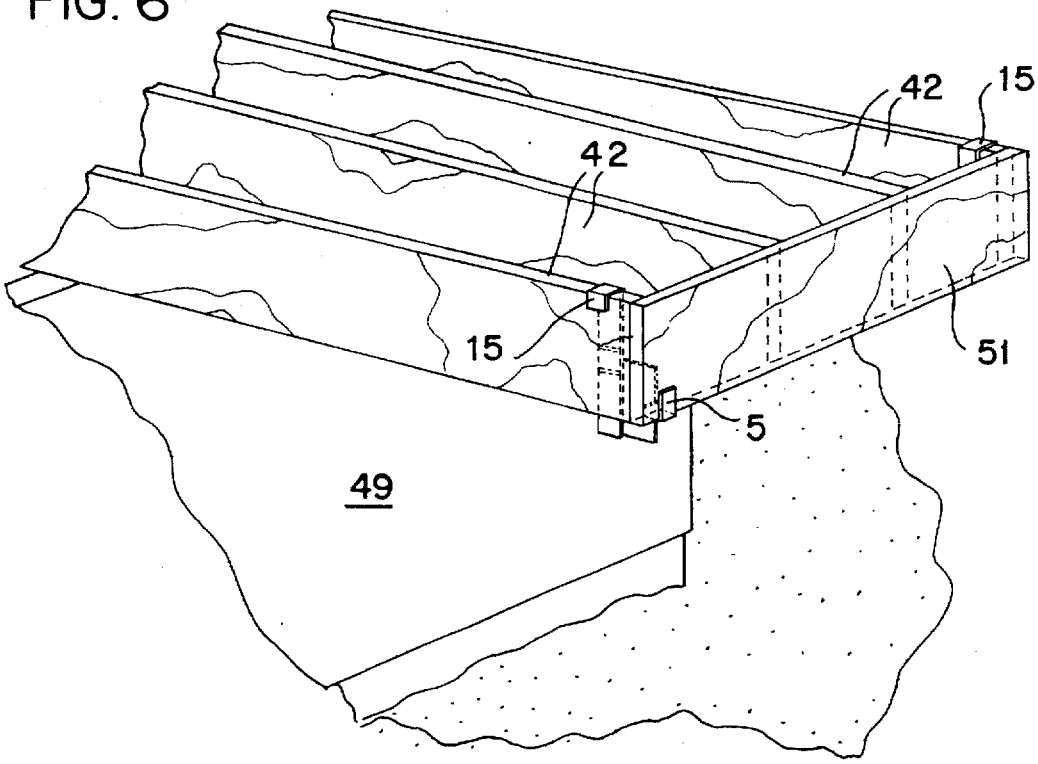
FIG. 6 depicts the holder as a rim joist jig attached to a floor joist.

FIG. 6 depicts the holder as a rim joist jig attached to a floor joist 42. In this application the floor joists are cantilevered out past a wall 49 and end with the rim joist 51 that is to be attached. The holder may be used to hold one end othe rim joist by the adjusted brackets 5 and 15 with nails through their respective brackets holes or, as shown, two holders can bracket the ends of the rim joist board 51. Attachment could be made from the top of the floor joist with more ease, making it safer that using a ladder when not as safety feasible such as when a house is built on a hill side. Other applications are also possible.

Although the Barge Buddy and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An adjustable board holder comprising:

a metal base plate member having an adjustment plate slot and a first board receiving bracket with nail receiving holes;

a metal body plate member having an extending member mounted on said plate, said extending member being adapted to be inserted within said base member adjustment slot, said metal body plate member being pivotally movable with respect to a second board receiving bracket attached to the body member and having nail receiving holes;

locking means for locking said base and body members to each other when said extending member is inserted in said base member's slot such that boards in said first and second brackets are oriented in a desired relationship.

2. The invention as claimed in claim 1, wherein said body member has a plurality of hinged plate sections with the uppermost section being pivotally mounted to said second bracket and the lowermost section mounting said extending member.

3. The invention as claimed in claim 2, wherein said extending member have threaded surfaces which can engage complementary threads on said locking means.

4. The invention as claimed in claim 3, wherein each of said brackets is U-shaped and has a lower flat board engaging surface and two side bracket surfaces with said nail receiving holes.

* * * * *